United States Patent [19]

Pyne

[11] Patent Number: 4,691,778

[45] Date of Patent: Sep. 8, 1987

[54] DOWNHOLE WATER FLOW CONTROLLER FOR AQUIFER STORAGE RECOVERY WELLS

[76] Inventor: R. David G. Pyne, 540 NE. 5th Ave., Gainesville, Fla. 32601

[21] Appl. No.: 13,078

[22] Filed: Feb. 9, 1987

[51] Int. Cl.[4] ..... E21B 34/08

[52] U.S. Cl. ..... 166/320; 137/493; 137/538; 166/321; 166/332

[58] Field of Search ..... 166/316, 53, 319, 320, 166/321, 332, 109, 112, 373, 242, 205, 324; 137/538, 493

[56] References Cited

U.S. PATENT DOCUMENTS

| | | | |
|---|---|---|---|
| 1,799,373 | 4/1931 | Humason | 166/205 |
| 3,120,267 | 2/1964 | Bayless | 166/332 X |
| 4,134,454 | 1/1979 | Taylor | 166/320 |

*Primary Examiner*—James A. Leppink

*Assistant Examiner*—Hoang C. Dang

*Attorney, Agent, or Firm*—Dowell & Dowell

[57] ABSTRACT

A downhole flow controller for use in recharge, injection and aquifer storage recovery (ASR) wells to prevent the free cascading of water and thereby eliminate the entrainment of air which may cause plugging of an aquifer wherein the controller includes a fixed tubular member which is selectively mounted to the lower end of a pump column of a well and in which an inner upwardly biased flow regulating tubular member is axially movable so as to automatically adjust the flow through vertically alignable openings through each of the fixed and movable tubular members dependent upon the direction of fluid flow, pressures and operating conditions within the well pump column and aquifer. In some embodiments, an adjustable flow regulating sleeve may be provided exteriorly of the fixed tubular member in order to vary the flow of fluid through the openings therein.

21 Claims, 6 Drawing Figures

DOWNHOLE WATER FLOW CONTROLLER FOR AQUIFER STORAGE RECOVERY WELLS

BACKGROUND OF THE INVENTION

1. Field of the Invention

This invention is generally directed to flow control devices for use in water wells and particularly to a downhole flow controller for use in recharge, injection and aquifer storage recovery wells wherein the flow controller continuously regulates the flow of water during both periods of water production and well recharging. During well recharging, the recharge water in the pump column of the well is controlled to prevent air from being entrained or trapped in the fluid flow into the aquifer which air entrainment can adversely effect the recharge operations by blocking the flow of water into the aquifer. In addition, the downhole flow controller automatically adjusts so that sufficient intake flow may be established therethrough during pumping or well production operations.

2. History of the Invention

Many communities have, and others are realizing the need for, a major investment in water supply, treatment and distribution facilities. Further, due to variability in both water supply and demand, it is necessary that adequate reserve capacity of these facilities be continuously maintained in anticipation of peak demands and droughts. Reserve capacity is expensive to construct and is operated infrequently. The use of system storage of treated water to meet hourly variations in supply and demand is cost-effective and conventional practice, however, to date, storage of sufficent volumes of treated water to meet seasonal and other long term variations in demand is prohibitively expensive.

In an effort to reduce facilities expansion costs, water resource engineers have become increasingly interested in the concept of storing large volumes of treated water in aquifers during months of the year when both water supply and facilities reserve capacity are available, to be recovered during times of peak demand. Recharge of aquifers through wells using untreated water is also receiving increased attention, particularly in water short areas. This concept of seasonal storage is called Aquifer Storage Recovery, or ASR. As an alternative to conventional expansion of water supply, treatment and distribution facilities, it is quite cost effective in areas where it is technically feasible. Generally the same wells are used for both recharge and recovery, and no retreatment of the water is necessary other than disinfection. The recharging of aquifers can be accomplished by using existing wells or by constructing new injection wells.

In addition to reduction in facilities expansion costs, other advantages favor ASR technology. In many coastal areas, low water levels in aquifers may permit the intrusion of salt water which can result in the destruction of the fresh water supply. In such areas, recharging of these aquifers can insure that conditions are maintained to prevent salt water intrusion, while at the same time helping to meet seasonal peak demands.

Such storage and water resource techniques have proven extremely advantageous and cost-effective in communities where declining ground water levels have left wells non-productive. They are beneficial in areas where existing ground water supplies are threatened by salt water or other contaminant intrusion. Well recharging is also effective where substantial storage reserves of treated water are necessary to improve system reliability in the event of a catastrophic loss to a primary water supply or in communities where additional strategically located water reserves are required to insure that pressures throughout a water distribution system are adequate during times of peak demand. Other environmental, water conservation and water quality benefits also favor ASR technology.

Although there are obvious benefits to be obtained from recharging existing water supply wells or in constructing new aquifer storage recovery wells, in many areas, problems have been encountered with air being entrapped in the aquifer thereby decreasing the effectiveness of recharging operations. Such air entrapment is most frequently encountered in areas or localities wherein one or more of three conditions exist. These conditions are encountered where the recharge water supply must drop a substantial depth to the existing subsurface water level; where the rate of recharge flow is relatively low; and where the specific capacity of the wells is relatively high. The foregoing adverse conditions have resulted in the cascading of water through the recharge well pipe thereby entrapping quantities of air which flow outwardly into the well or aquifer. The trapped or entrained air can thus effectively plug or seal the aquifer resulting in substantially lower storage capacity.

Although there have been many flow controllers designed and developed for use in the oil and gas industry, such controllers have not been designed nor are they suitable for use in controlling cascading in recharge, injection or aquifer storage recovery wells. One alternative which has been used for the elimination of the problems of air entrapment involves the use of multiple small injection tubes to supply the water to the aquifer. Such an alternative is only possible in wells having large well pipe diameters. It is therefore costly and is not generally suitable for retrofitting existing wells.

SUMMARY OF THE INVENTION

This invention is directed to a downhole flow control device for continuously regulating the flow of water both during water well production and recharge operations in recharge, injection or aquifer storage recovery wells. During recharging operations, the flow is controlled in order to prevent cascading of the recharge fluid which would otherwise lead to aquifer plugging through air entrapment in the subsurface storage areas. The device includes two concentric cylinders or tubular members each of which has multiple ports or openings therethrough which are selectively vertically aligned by the relative movement or vertical displacement of one of the cylinders with respect to the other. The outer cylinder is connected or joined to the bottom of the injection pipe or pump column and is closed at its lower end with the exception of a pressure relief opening or valve. The inner cylinder is mounted for vertical movement with respect to the generally fixed outer cylinder and is positively biased upwardly with respect thereto by springs or resilient members which are preselected or adjusted to create a constant upwardly directed force. The lower end of the movable cylinder is also closed with the exception of a pressure relief opening therethrough. The area between the lower ends of the fixed and movable cylinders creates a pressure chamber which also acts to exert an upward pressure or force on the movable cylinder and serves as the housing for the resilient biasing members A guide sleeve or ring is provided to insure that the movement of the movable cylinder is only vertical and that such movement is limited to a predetermined extent. The total of the forces normally exerted upwardly on the movable cylinder are such as to insure that during recharging of the well that a solid column of water is established vertically above the multiple ports or openings through the concentric cylinders prior to the movable cylinder being vertically displaced to a position where flow is established through the aligned ports or openings of the cylinders. Further, the alignment of openings and the vertical displacement of the movable cylinder are designed to insure proper or sufficient flow rate when water is being pumped from the well. In some embodiments of the invention, additional flow control is provided by utilizing an outer sleeve which is selectively positioned or controlled from a remote location at the well head to block the flow of liquid through one or more of the openings in the cylinders to thereby additionally adjust the flow therethrough.

In dual purpose wells used for both water supply and recharge (also known as aquifer storage recovery, or ASR, wells), the flow control device of the present invention is installed at the base of the pump column, just below the pump bowls, and serves as both the pump intake and strainer during recovery or production and the throttling valve during recharge through the pump column. In single purpose recharge or injection wells, the device is connected to the bottom of the injection tubing.

It is the primary object of the present invention to provide a downhole flow control device for use with recharge, injection and aquifer storage recovery (ASR) wells wherein the flow of recharge water is facilitated and controlled in order to eliminate a significant amount of aquifer or well plugging through air binding or entrapment.

It is another object of the present invention to provide a downhole flow control device which is suitable for continuous operation in recharge, injection and ASR wells and which is operable to prevent free cascading of recharge water during well recharging operations and which functions as and replaces the conventional cone strainers usually provided in conventional supply wells during well production.

It is yet another object of the present invention to provide a downhole flow control device for recharge, injection and ASR wells which is designed to be incorporated within either existing or new wells in order to reduce air entrainment which is normally associated with well recharging operations.

It is also an object of the present invention to provide a simple, durable and cost effective flow controller for regulating the flow both into and out of recharge, injection and ASR wells in order to prevent cascading during recharge and which assures a desired well flow during production and which can be adjusted to meet the specific static and operational pressures which are encountered or anticipated in a variety of environments.

It is a further object of the present invention to provide a downhole flow control device for preventing air binding in recharge, injection and ASR wells wherein minor adjustment to flow may be selectively regulated from the well head.

DESCRIPTION OF THE PREFERRED EMBODIMENT

Figure 1:
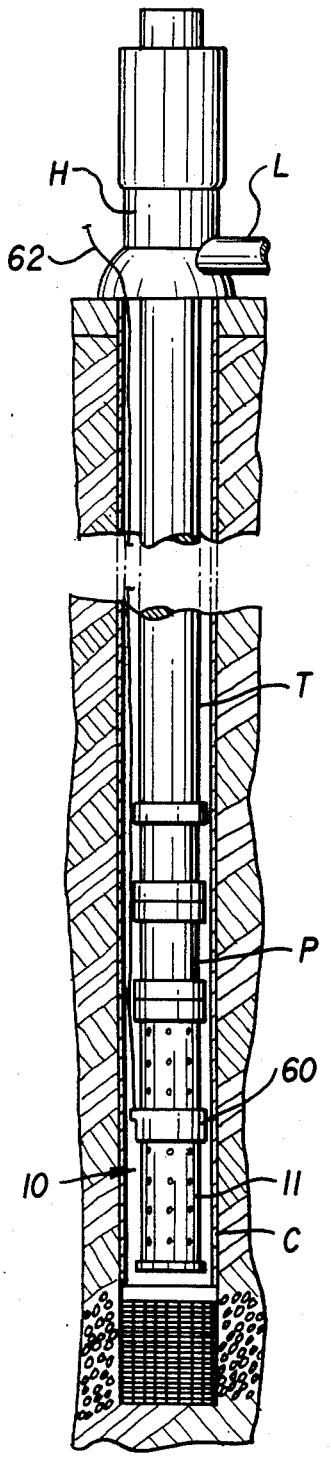
FIG. 1 is a vertical cross sectional view through an ASR well illustrating the location of the invention at the bottom of the pump column or injection tubing and within the well casing.

With continued reference to the drawings, the downhole flow controller 10 of the present invention is shown in FIG. 1 as it is mounted to the bottom of a pump bowl P which is normally or conventionally used in aquifer storage recovery wells (hereinafter ASR wells) and which is mounted at the bottom of the pump bowl P so as to be within the well casing C. In a like manner, the flow controller may be mounted to the bottom of an injection well tubing T which is disposed or oriented within the well casing of an injection or recharge well. In the embodiment shown, the pump column or tubing T extends downwardly from the well head H. Extending from the well head are one or more water supply and discharge lines L for use in either conveying water to the well during well recharging or for carrying water from the well when the well is in a production mode.

The flow controller 10 consists of an outer fixed cylinder 11 which is provided at its upper end with external screw threads 12 which are adapted to be engagable with the lower pipe section or pump bowl of the well tubing. The upper portion of the fixed cylinder is also provided with internal screw threads shown at 13 for purposes of providing a mating surface for selectively receiving a guide sleeve assembly 14. The lower end of the fixed cylinder is also provided with external screw threading 15 which is provided for the selective attachment of an end cap 16.

Movably positioned within the fixed cylinder 11 is an adjustable or movable cylinder 18 which is of a diameter to be closely spaced and yet slideable with respect to the interior side walls of the fixed outer cylinder. The annular space between the inner cylinder and the outer cylinder is typically 0.005 to 0.010 inch. The inner movable cylinder is shown as having a closed bottom wall 19 and is open at the top end 20 thereof. One or more key slots 21 are formed in the upper end or wall portions of the movable cylinder for purposes of receiving depending guide flanges 22 which are carried by the guide sleeve assembly 14. As noted, the guide sleeve assembly is threadingly mounted to the inner portion of the fixed cylinder and includes an annular ring body portion 23 from which the downwardly extending guide flanges 22 extend. In this manner, the vertical adjustment of the inner movable cylinder will be controlled so that no rotation of the inner cylinder is possible with respect to the outer cylinder. In addition, the bottom edges 24 of the guide flanges will also function as a bearing surface or stop which will effectively limit the upward movement of the movable inner cylinder 18.

The outer fixed cylinder 11 is provided with several bands of ports or openings 25. These openings are annularly arranged in substantially equally spaced relationship with respect to one another about the outer surface of the cylinder. Each band of openings is spaced vertically with respect to the adjacent band by a predetermined distance. The openings or ports 25 are outlets which are provided to convey water outwardly to the surrounding aquifer during well recharging operations. The number and diameter of the holes around the circumference of each band may vary but should be sufficient to allow for a desired flow rate of recharging fluid. Likewise, the number of bands of openings may be varied and the length of the outer cylinder may be adjusted to accommodate additional bands of openings if necessary. The number of outlet openings 25 in each band is generally less adjacent the top of the outer cylinder and greater adjacent the bottom portion thereof. In addition, although generally circular openings have been shown, it is possible that the openings can be in other shapes or formed as slots through the outer cylinder.

Figure 5:
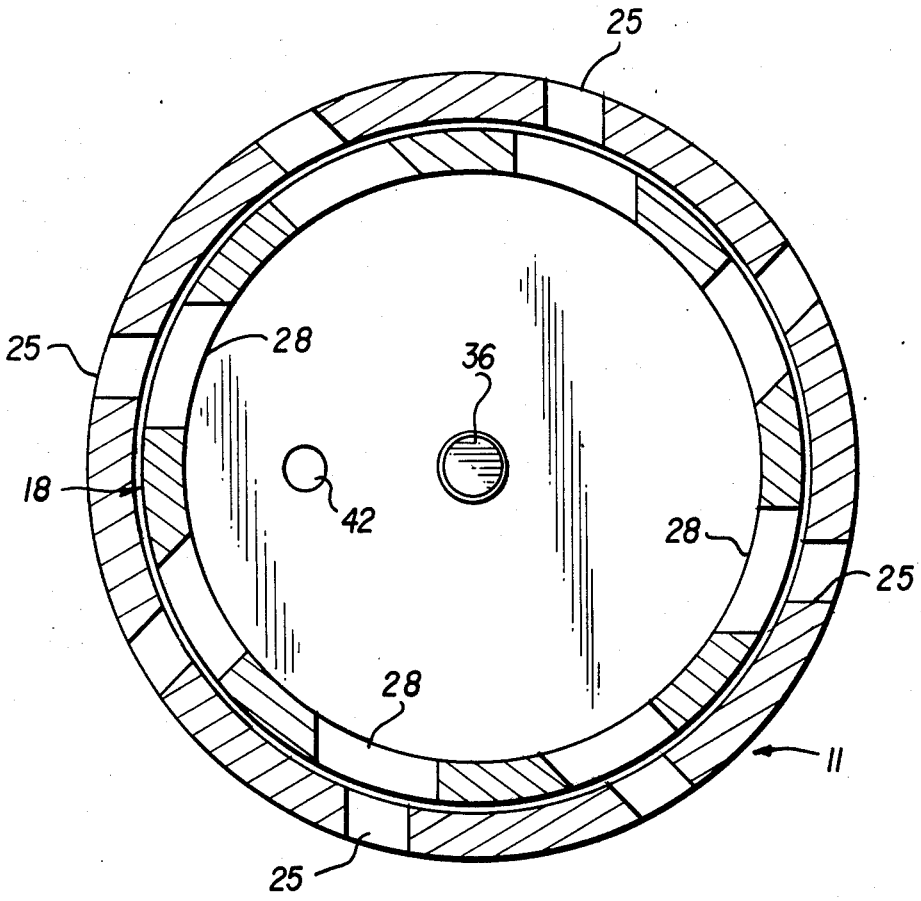
FIG. 5 is a typical cross sectional view of the fixed and movable flow control cylinders.

With particular reference to FIG. 5, it is preferred that the ports or openings 25 be constructed or positioned at an angle through the side walls of the outer cylinder. A preferred angle would be between 15° to 35° relative to the surface of the cylinder as taken from a plane generally perpendicular to the length thereof. The angled configuration, as shown in FIG. 5, will promote a spiral circulation of recharge water around the controller within the well casing and thereby enhance the release of any small amount of entrained air which might otherwise be retained in the discharge flow.

In addition to the outlet flow openings 25, a second series of bands of annular openings 26 are provided through the side walls of the outer fixed cylinder in spaced and alternating relationship with respect to the openings 25. The openings 26 serve as inlet flow openings through which fluid flow from the aquifer is delivered to the pump column during well production. Generally, the number and size of openings may vary, however, the spacing between each of the bands of openings 25 and 26 is equal and the number of inlet flow openings in each band 26 is equal.

The inner movable cylinder 18 is also provided with bands of openings 28 through the side walls thereof. The vertical spacing between each of the bands of openings 28 equals the spacing between the bands of openings 25 or 26 through the outer fixed cylinder. In addition, the spacing of the openings about the circumference of the inner pipe should be the same as the spacing of the openings through the outer cylinder so that the openings 25 and 26 may be selectively aligned with the openings 28 depending upon the vertical positioning of the movable cylinder within the fixed cylinder. It should also be noted that the openings 28 are formed having a larger diameter than the openings 25 and 26 and are angularly positioned as are the openings 25 so as to assist in creating a circular flow of fluid outwardly of the flow control device when openings 25 and 28 are aligned during a well recharging operation.

Figure 2:
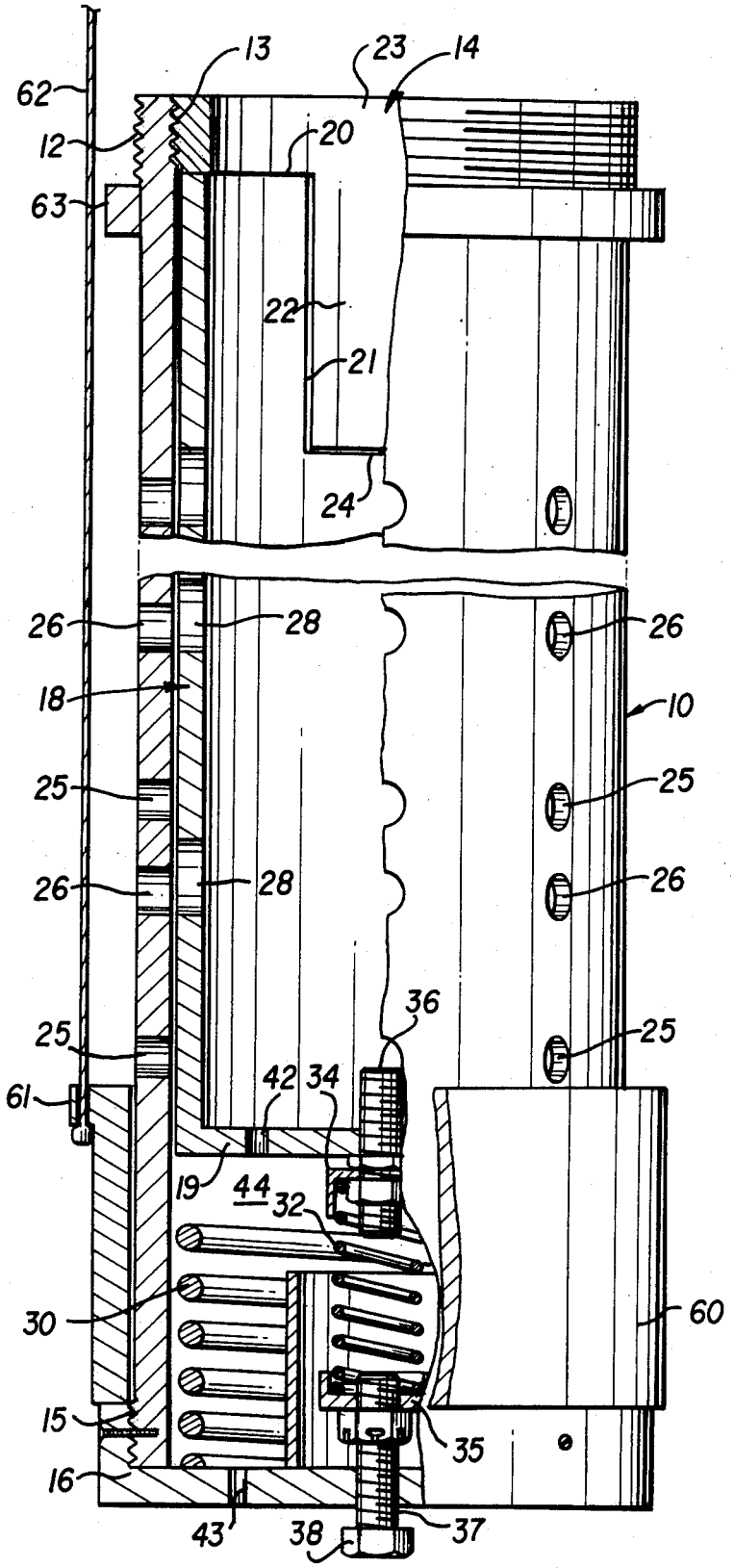
FIG. 2 is an enlarged front elevational view which is partially in section showing the relative positioning of the fixed and movable flow control cylinders during a well production mode.
Figure 3:
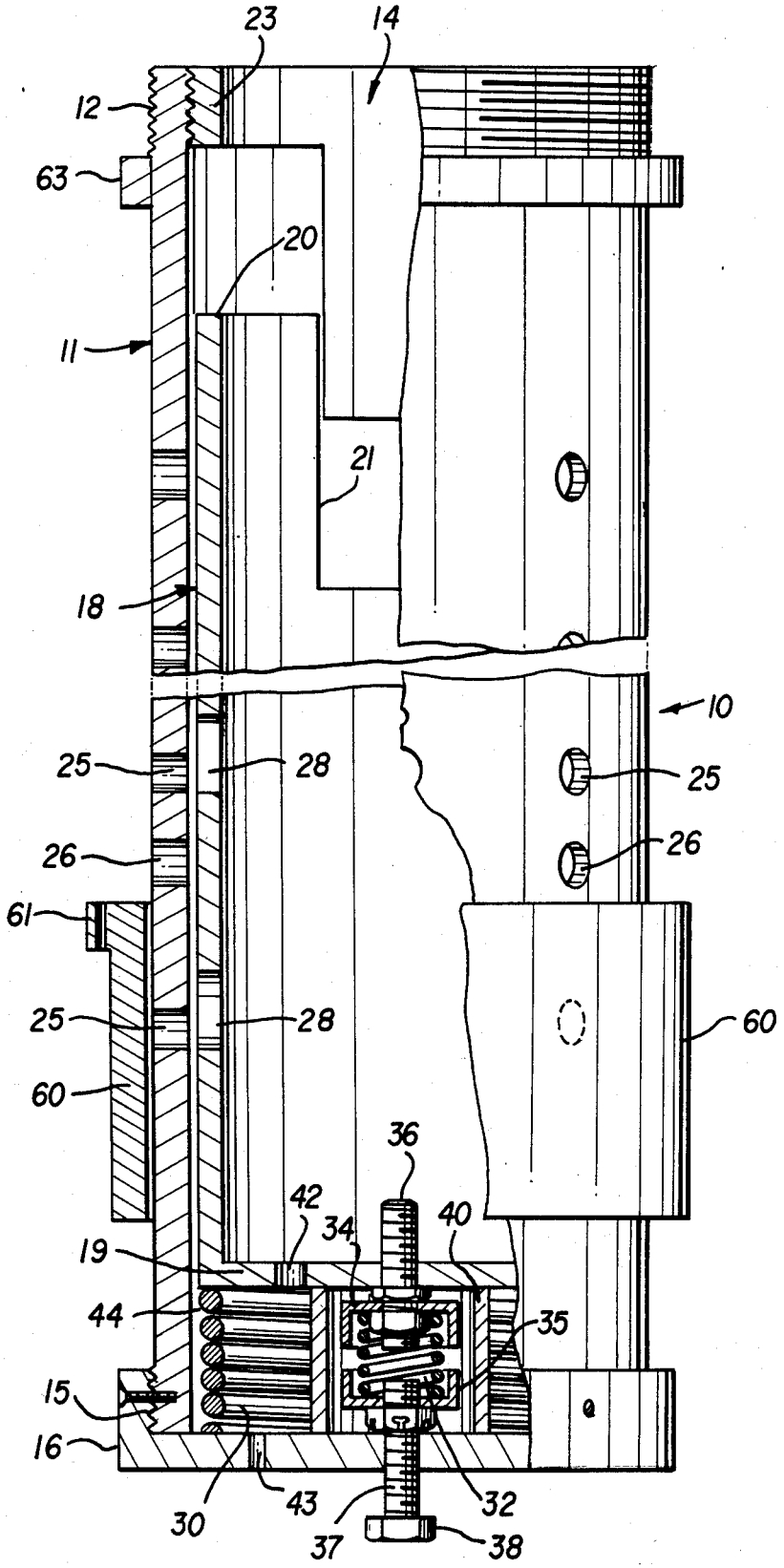
FIG. 3 is an enlarged front elevational view which is partially in cross section showing the relative positioning of the fixed and movable flow control cylinders during a well recharge mode.
Figure 4:
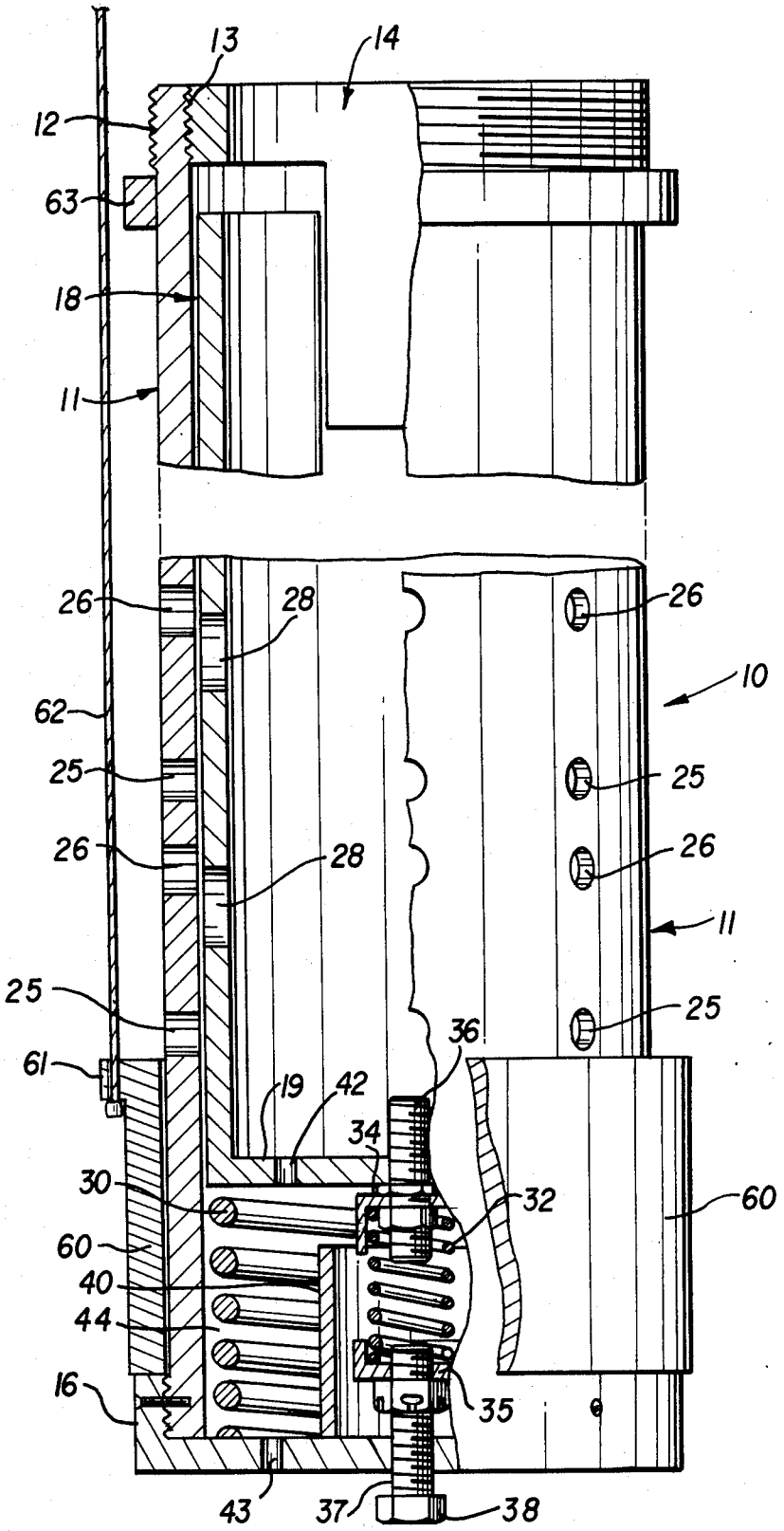
FIG. 4 is an enlarged front elevational view which is partially in section showing the relative positioning of the fixed and movable flow control cylinders as initially oriented when the well is static, that is, neither being recharged or producing.

The recharging alignment of the inner and outer cylinders is disclosed in FIG. 3. During well production operations, the inner cylinder will be vertically elevated with respect to the outer fixed cylinder so as to assume an alignment as shown in FIG. 2 wherein the openings 28 are aligned to receive water coming through inlet openings 26 through the outer cylinder. During periods when there is no flow through the pipe column, the inner cylinder is normally adjusted so as to be positioned as shown in FIG. 4 of the drawings wherein the openings 28 are only partially aligned with the inlet openings 26.

A particularly unique feature of the present invention is the ability of the flow controller 10 to operate in a dual mode either during well production or during well recharge. To this end, the inner cylinder is mounted within the outer cylinder so as to be automatically adjusted or aligned with respect thereto so as to vary the flow either in or out of the controller to limit the flow depending upon the pressures established within the pipe column and pressures surrounding the flow controller within the bottom of the well or aquifer. As shown, the inner cylinder is provided with a positive mechanical biasing member and is also automatically affected by the relative pressures within and around the flow controller.

The mechanical biasing of the inner cylinder is normally accomplished by means of concentrically positioned spring elements 30 and 32 which are mounted between the end cap 16 of the outer cylinder and the closed bottom wall 19 of the inner movable cylinder. The spring elements are provided to exert sufficient force upwardly with respect to the inner movable cylinder so as to insure that the openings 28 in the inner cylinder will not come into alignment with the discharge openings 25 in the outer cylinder during recharge operations until a sufficient column of fluid has been established within the injection tubing or pump column and above the closed end wall 19 of the inner cylinder. Spring 30 is shown as a single spring, however, it is possible that two or more springs may be utilized. The spring 32 is generally weaker than spring 30 and is provided for initially supporting the inner movable cylinder in elevated relationship with respect to the spring 30. During well shut-down or static periods, the spring 32 should exert just enough force to retain the movable cylinder in a position as disclosed in FIG. 4. The spring 32 must also be easily compressed so that as soon as recharge water is introduced into the pump column or well tubing T, the additional force or pressure created or established will quickly force the movable cylinder downwardly against spring 32 and against the stronger spring element 30. In this position, the openings 28 in the movable cylinder will not be aligned with either of the bands of openings 25 or 26, and therefore, no fluid flow will be permitted through the flow controller 10.

Therefore, as the spring 32 is initially compressed during the recharging of the well or aquifer, the air which is normally entrapped with the cascading water initially entering and dropping through the well string will have an opportunity to rise in the column of water which is momentarily closed from flowing outwardly into the aquifer or well area. The flow into the well or aquifer will be prohibited until such time as the openings 28 and 25 are aligned by appropriate compression of the inner cylinder against the stronger spring 30 due to an increase in pressure within the pump column or well tubing T. Thus, the flow into the well or aquifer will begin and increase as the openings 28 are progressively aligned with the openings 25 by continued compression of the springs 30 and 32.

In order to adjust the static vertical alignment of the inner movable cylinder, the spring element 32 is adjustable. In the embodiment shown, the spring element 32 is shown as being seated between bearing surfaces 34 and 35 which are respectively engaged through the end walls of the inner cylinder and the outer cylinder by way of mounting bolts 36 and 37. Bearing surface 34 rests upon, but is not attached to, spring 32. Bearing surface 35 supports, and may be attached to, spring 32. The mounting bolt 37 has a head portion 38 which can be adjusted from the exterior of the controller prior to its installation in the well so as to adjust the bearing surface 35 and thereby adjust vertical alignment of the inner movable cylinder.

The downward stroke of the inner cylinder is effectively limited to prevent damage to the spring elements which could otherwise occur if such elements were fully compressed. A cylindrical abutment or stop member 40 is shown as being disposed around the inner spring element 32 and is attached to the end cap 16 so as to extend upwardly with respect thereto. The length of the stop member should be sufficient to prevent the spring elements 32 and 30 from being fully compressed when the inner cylinder is in its most downward position as shown in FIG. 3.

In addition to the mechanical biasing of the inner cylinder with respect to the outer cylinder, openings 42 and 43 are provided through the end wall of the inner cylinder and the end cap of the outer cylinder, respectively. The openings 42 and 43 are provided so as to permit a small amount of fluid within the flow controller to pass into the housing area 44 defined between the end cap 16 and the lower wall 19 of the inner cylinder, In this respect, the end wall of the inner cylinder 19 serves as a piston with the top face thereof having a predetermined surface area defined by the inner diameter of the inner cylinder minus the area of the opening 42 therein. Pressure acting upon the upper face of the end wall creates a downward force which is opposed by the compression of the springs 30 and 32 and also by the pressure occurring within the spring chamber 44 which acts upwardly against the bottom face of the end wall. The area of pressure on the bottom face of the end wall of the inner cylinder is defined by the outside diameter of the inner cylinder less the area of the opening 42 therethrough. The differential force acting upon the end wall 19 of the inner movable cylinder may therefore be adjusted by varying the cross sectional areas of the openings 42 and 43 with respect to one another. The opening 43 is open to the exterior pressure within the well and therefore the pressure within chamber 44 may be decreased as fluid passes through opening 43. Therefore, the opening 42 is usually larger than the opening 43 so that the influence of the pressure within the pipe string is more significant.

Figure 6:
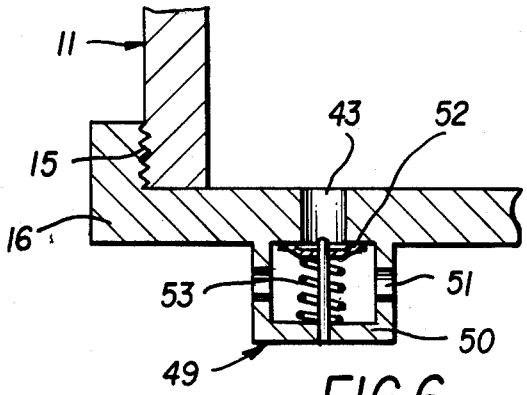
FIG. 6 is an enlarged partial cross sectional view of a modified embodiment of the invention showing a pressure regulating valve used in conjunction with the pressure relief opening through the lower end of the fixed flow control cylinder.

With particular reference to FIG. 6, in some instances it may be advisable to place a valve member 49 within the opening 43 so as to insure that the opening 43 is maintained in a relatively closed position until just prior to the time when the inner cylinder reaches its downward limit of motion. As shown, the valve 49 includes a housing 50 which is positioned over the exterior of the opening 43. The valve housing has a plurality of fluid openings 51 therein and includes a valve closure member 52 which is resiliently urged into closed or sealed relationship with the opening 43 by spring element 53. It should be noted that any suitable type of valve member could be utilized with the invention, it being only necessary that the valve be such as to be operable at a predetermined pressure so as to allow the pressure within the chamber 44 to be relieved and thereby insure that the inner movable cylinder is no longer resisted by fluid pressure in chamber 44. Upon the release of pressure in chamber 44, the inner cylinder will move down until it contacts the stop member 40 thereby aligning the openings 28 with the discharge openings 25.

To permit further adjustment to the flow characteristics through the openings 25 in the outer fixed cylinder, the flow control device of the present invention may include an outer adjustable sleeve member 60 which surrounds and is movable with respect to the outer cylinder. The outer sleeve includes at least one flanged portion 61 for receiving a control wire 62 which extends upwardly to the well head which may be utilized to adjust the sleeve vertically relative to the outer cylinder to thereby cause the sleeve to effectively block the flow through one or more bands of outlet openings 25 therethrough. Typically, a space of 0.02 to 0.03 inch is created between the sleeve and the outer cylinder so as to provide clearance for the sleeve to move relative to the outer cylinder. Although not shown in the drawings, bearing elements or rings may be incorporated with the sleeve in order to facilitate a non-binding vertical movement relative to the outer cylinder of the flow controller. Upward movement of the outer sleeve 60 may be limited by a stop ring 63 attached to the outside of the upper end of outer cylinder 11 by the threaded connection 12 or other means. As previously discussed, the number of openings in each band of outlet openings 25 are fewer adjacent the upper end of the cylinder 11. Therefore, the upward movement of the sleeve 60 will cause fewer ports or openings to be covered thereby increasing flow through the controller and lowering wellhead pressure. Downward movement will cause the sleeve 60 to cover more openings thereby decreasing flow through the device and increasing water level in the pump column.

In the use of the flow controller of the present invention, under static conditions, the vertical alignment of the inner and outer cylinders is maintained by the static compression spring 32 acting upon the end wall of the inner adjustable cylinder so as to achieve the position of alignment as shown in FIG. 4 of the drawings where there is some communication between the openings 28 and the inlet openings 26. During pump start-up and production operations, the suction in the well tubing will create a negative pressure relative to the lower wall of the inner movable cylinder which will combine with the force of the inner spring element 32 to urge the inner cylinder upwardly so as to align the openings 28 with the inlet openings 26 so that an unblocked flow of fluid may be established therebetween. Again, sufficient openings 26 and 28 are provided to insure that little loss in head is created within the pump intake and that the design flow rate for the well is easily maintained. During well production operations, the flow control device operates similarly to conventional cone strainers currently used in water supply wells.

During the initiation of water recharge, a small increase of pressure caused by flow down the pump column will initially compress the spring element 32 thereby immediately closing off the openings 28 from the openings 26 and preventing flow into the aquifer from the well string. With further spring compression caused by the increased head of water in the column after the column has almost filled, the discharge openings 25 will begin to be exposed to the openings 28 in the inner column thereby allowing a flow outwardly of the column and into the aquifer. At maximum opening during recharge, the water level will be at or slightly above the pump base at the well head.

The effective movement of the inner cylinder may be adjusted prior to the insertion of the flow controller into the well by adjusting the settings of mounting bolts 36 and 37. Although only two openings 42 and 43 are shown in the preferred embodiment, a plurality of such openings may be provided with the size of such openings being varied to regulate the effective pressure which is created within the spring chamber 44 and which may act upwardly upon the lower or outer face of the inner cylinder end wall.

Further adjustment to the flow within the flow controller may be made remotely by adjusting the sleeve 60 so as to selectively block the flow of fluid through one or more bands of openings 25 in the outer cylinder. Such adjustment may be made in order to block the flow rate outwardly of the well string during recharge operations.

I claim:

1. A downhole flow control device for continuous automatic control of water flowing into or out of wells, aquifers and the like through pipe columns including pump columns and injection pipes so as to prevent cascading during recharging comprising a first tubular member having upper and lower ends and side walls, said upper end of said first tubular member being mounted to the pipe column so as to be in fluid communication therewith, said lower end of said first tubular member being substantially closed, a second tubular member mounted concentrically within and proximate to said first tubular member and having an open upper end and side walls and a substantially closed lower end, a plurality of first and second openings through said side walls of said first tubular member, said first openings being spaced in vertical relationship to said second openings, a plurality of third openings through said second tubular member, said second tubular member being vertically movable with respect to said first tubular member so as to selectively align said third openings with either of said first and second openings, biasing means located between said lower ends of said first and second tubular members for normally urging said second tubular member vertically upward with respect to said first tubular member, said biasing means being yieldable upon the introduction of water into the pump column to permit said second tubular member to be vertically displaced relative to said first tubular member to thereby close said third openings with respect to said first or second openings and thereafter permitting said third openings to align with one of said first and second openings dependent upon the direction of fluid flow within the pipe column.

2. The downhole flow control device of claim 1 in which said biasing means includes first and second resilient members, said first resilient member normally supporting said second tubular member in spaced elevated relationship with said second resilient member when the conditions within the pipe column are relatively static, said first resilient member being yieldable as water is initially introduced into the pipe column during recharge so that said second tubular member is moved to contact said second resilient member, said second resilient member being yieldable to permit the vertical displacement of the second tubular member when a column of water is developed within the pipe column which extends above said first and second openings in said first tubular member.

3. The downhole flow control device of claim 2 in which said first and second resilient means are first and second concentrically oriented springs, respectively, said second spring being relatively shorter than said first spring.

4. The downhole flow control device of claim 3 including adjusting means connected to said first spring means for selectively adjusting the vertical alignment of said second tubular member relative to said first tubular member.

5. The downhole flow control device of claim 4 including stop means disposed between said lower ends of said first and second tubular members, said stop means extending upwardly a distance which will limit the compression of said first and second springs and being relatively shorter than said second spring.

6. The downhole flow control device of claim 5 including at least one opening in said lower end of said second tubular member and at least one opening in said lower end of said first tubular member for permitting the adjustment of fluid pressure between said lower ends of said first and second tubular members.

7. The downhole flow control device of claim 6 including a plurality of annularly oriented bands of said first and second openings through said side walls of said first tubular member, each of said bands being alternately spaced in a predetermined vertical relationship along the length of said first tubular member, and a plurality of annularly oriented bands of said third openings in said side walls of second tubular member, said bands of said third openings being spaced in said predetermined vertical relationship.

8. The downhole flow control device of claim 7 including guide means disposed within said first tubular member for preventing the rotational movement of said second tubular member with respect thereto.

9. The downhole flow control device of claim 8 in which said guide means includes stop means for limiting the vertical movement of said second tubular member.

10. The downhole flow control device of claim 9 in which said guide means includes a ring means, said upper end of said first tubular member having inner and outer screw threads, said ring means being selectively secured to said inner screw threads and having at least one depending side wall portion, said second tubular member having at least one slot formed in the side wall extending downwardly from said upper end thereof, said depending wall portion of said ring means being receivable within said slot in said second tubular member.

11. The downhole flow control device of claim 10 including an outer sleeve means surrounding said first tubular member and being in closely spaced proximity thereto, said outer sleeve means being selectively vertically adjustable so as to block the flow through at least one of said bands of said first and second openings, and control means extending from said sleeve means, whereby said control means can be utilized to vertically adjust the position of said sleeve means to vary the flow of water through said openings in said first tubular member.

12. The downhole flow control device of claim 6 including valve means normally closing said at least one opening in said lower end of said first tubular member, said valve means being operational to open said at least one opening as said lower end of said second tubular member moves adjacent said stop means.

13. A downhole flow control device for continuous automatic control of water flowing into or out of a well, aquifer and the like through pipe columns including pump columns and injection pipes so as to prevent cascading during recharging comprising a first tubular member having upper and lower ends and side walls, said upper end of said first tubular member being mounted to the pipe column so as to be in fluid communication therewith, said lower end of said first tubular member being substantially closed, a second tubular member mounted concentrically within and proximate to said first tubular member and having an open upper end and side walls and a substantially closed lower end, a plurality of annular oriented and vertically spaced bands of first and second openings through said side walls of said first tubular member, each of said bands being spaced in a predetermined vertical relationship along the length of said first tubular member, a plurality of annular oriented and vertically spaced bands of third openings through said side walls of second tubular member, said second tubular member being vertically movable with respect to said first tubular member so as to selectively align said band of third openings with either of said bands of first and second openings, first and second resilient members located between said lower ends of said first and second tubular members for normally urging said second tubular member vertically upward with respect to said first tubular member, said first resilient member normally supporting said second tubular member in spaced elevated relationship with said second resilient member when the conditions within the pipe column are relatively static, said first resilient member being yieldable as water is initially introduced into the pipe column during recharge so that said second tubular member is vertically displaced relative to said first tubular member to thereby close said band of third openings with respect to said bands of first and second openings and thereafter contacts said second resilient member, said second resilient member being yieldable to permit the vertical displacement of the second tubular member when a column of water is developed within the pipe column which extends above said openings in said first tubular member thereby permitting said band of third openings to align with one of said bands of first and second openings dependent upon the direction of fluid flow within the pipe column.

14. The downhole flow control device of claim 13 including adjusting means connected to said first resilient member for selectively adjusting the static vertical alignment of said second tubular member relative to said first tubular member.

15. The downhole flow control device of claim 13 including stop means disposed between said lower ends of said first and second tubular members, said stop means extending upwardly a distance which will limit the compression of said first and second resilient members and being relatively shorter than said second resilient member.

16. The downhole flow control device of claim 13 including at least one opening in said lower end of said second tubular member and at least one opening in said lower end of said first tubular member for permitting the adjustment of fluid pressure between said lower ends of said first and second tubular members.

17. The downhole flow control device of claim 13 including guide means disposed within said first tubular member for preventing the rotational movement of said second tubular member with respect thereto, said guide means including stop means for limiting the vertical movement of said second tubular member.

18. The downhole flow control device of claim 13 including an outer sleeve means surrounding said first tubular member and being in closely spaced proximity thereto, said outer sleeve means being selectively vertically adjustable so as to block the flow through at least one of said bands of first and second openings, and control means extending from said sleeve means, whereby said control means can be utilized to vertically adjust the position of said sleeve means to vary the flow of water through said bands of first and second openings in said first tubular member.

19. A downhole flow control device for continuous automatic control of water flowing into or out of well, aquifers and the like through pipe columns including pump columns and injection pipes so as to prevent cascading during recharging comprising a first tubular member having upper and lower ends and side walls, said upper end of said first tubular member being mounted to the pipe column so as to be in fluid communication therewith, said lower end of said first tubular member being substantially closed, a second tubular member mounted concentrically within and proximate to said first tubular member and having an open upper end and side walls and a substantially closed lower end, a plurality of vertically spaced bands of first and second openings through said side walls of said first tubular member, said bands of first openings being spaced a predetermined distance with respect to one another, said bands of second openings being spaced said predetermined distance from one another and alternating vertically with said bands of first openings, a plurality of bands of third openings through said second tubular member, said second tubular member being vertically movable with respect to said first tubular member so as to selectively align said band of third openings with either of said bands of first and second openings, biasing means located between said lower ends of said first and second tubular members for normally urging said second tubular member vertically upward with respect to said first tubular member, said biasing means being yieldable upon the introduction of water into the pipe column to permit said second tubular member to be vertically displaced relative to said first tubular member to thereby close said third openings with respect to said first or second openings and thereafter permitting said third openings to align with one of said first and second openings dependent upon the direction of fluid flow within the pipe column, at least one opening in said lower end of said second tubular member and at least one opening in said lower end of said first tubular member for permitting the adjustment of fluid pressure between said lower ends of said first and second tubular members, guide means carried by said first tubular member for preventing the rotational movement of said second tubular member with respect thereto, said guide means having stop means for limiting the vertical movement of said second tubular member.

20. The downhole flow control device of claim 19 in which said biasing means includes first and second spring means, said first spring means normally supporting said second tubular member in spaced elevated relationship with said second spring means when the conditions within the pipe column are relatively static, said first spring means being yieldable as water is initially introduced into the pipe column during recharge so that said second tubular member is moved to contact said second spring means, said second spring means being yieldable to permit the vertical displacement of the second tubular member when a column of water is developed within the pipe column which extends above said openings in said first tubular member.

21. The downhole flow control device of claim 20 including stop means disposed between said lower ends of said first and second tubular member, said stop means extending upwardly a distance which will limit the compression of said first and second spring means and being relatively shorter than said second spring means.

* * * * *